US008761421B2

(12) United States Patent
Apfel

(10) Patent No.: US 8,761,421 B2
(45) Date of Patent: Jun. 24, 2014

(54) PORTABLE ELECTRONIC DEVICE AND COMPUTER-READABLE MEDIUM FOR REMOTE HEARING AID PROFILE STORAGE

(75) Inventor: Russell J. Apfel, Austin, TX (US)

(73) Assignee: Audiotoniq, Inc., Austin, TX (US)

( * ) Notice: Subject to any disclaimer, the term of this patent is extended or adjusted under 35 U.S.C. 154(b) by 159 days.

(21) Appl. No.: 13/007,568

(22) Filed: Jan. 14, 2011

(65) Prior Publication Data

US 2012/0183163 A1 Jul. 19, 2012

(51) Int. Cl.
*H04R 25/00* (2006.01)

(52) U.S. Cl.
USPC ..... 381/315; 381/313

(58) Field of Classification Search
CPC ..... H04R 25/00
USPC ..... 381/314, 315, 312, 313
See application file for complete search history.

(56) References Cited

U.S. PATENT DOCUMENTS

| | | | | |
|---|---|---|---|---|
| 4,845,755 | A | 7/1989 | Busch | |
| 5,303,306 | A | 4/1994 | Brillhart | |
| 5,524,150 | A | 6/1996 | Sauer | |
| 5,608,803 | A | 3/1997 | Magotra et al. | |
| 5,721,783 | A | 2/1998 | Anderson | |
| 5,727,070 | A | 3/1998 | Coninx | |
| 6,078,675 | A | 6/2000 | Bowen-Nielsen et al. | |
| 6,532,294 | B1 | 3/2003 | Rudell | |
| 6,920,229 | B2 | 7/2005 | Boesen | |
| 7,010,133 | B2 | 3/2006 | Chalupper | |
| 7,167,571 | B2 | 1/2007 | Bantz et al. | |
| 7,324,650 | B2 | 1/2008 | Fischer | |
| 7,451,256 | B2 | 11/2008 | Hagen | |
| 7,499,686 | B2 | 3/2009 | Sinclair et al. | |
| 7,529,545 | B2 | 5/2009 | Rader et al. | |
| 7,561,708 | B2 | 7/2009 | Rohrlein | |
| 7,715,576 | B2 | 5/2010 | Ribic | |
| 7,778,432 | B2 * | 8/2010 | Larsen | 381/315 |
| 7,787,647 | B2 | 8/2010 | Hagen et al. | |
| 7,826,631 | B2 | 11/2010 | Fischer | |
| 7,853,028 | B2 | 12/2010 | Fischer | |
| 8,265,315 | B2 | 9/2012 | Sorensen et al. | |
| 2005/0281424 | A1 | 12/2005 | Rass | |
| 2006/0198530 | A1 | 9/2006 | Fischer et al. | |
| 2008/0240477 | A1 | 10/2008 | Howard et al. | |
| 2009/0074216 | A1 * | 3/2009 | Bradford et al. | 381/315 |
| 2010/0054511 | A1 | 3/2010 | Wu et al. | |
| 2010/0202637 | A1 * | 8/2010 | Cornelisse et al. | 381/314 |
| 2011/0176697 | A1 * | 7/2011 | Apfel et al. | 381/314 |
| 2011/0200215 | A1 * | 8/2011 | Apfel et al. | 381/314 |
| 2014/0003641 | A1 | 1/2014 | Neumeyer et al. | |

OTHER PUBLICATIONS

Resound Alera: End User Brochure, instructional brochure, 2010, M101100-GB-10.02 Rev.A, GN ReSound Group, USA 7 pages.

(Continued)

*Primary Examiner* — Brian Ensey
(74) *Attorney, Agent, or Firm* — Lee & Hayes, PLLC

(57) ABSTRACT

A portable electronic device includes a transceiver configurable to communicate with a hearing aid through a radio frequency (RF) communication channel and a memory configured to store a plurality of hearing aid profiles executable by a digital signal processor of the hearing aid to shape audio signals to compensate for a user's hearing deficiency. The portable electronic device further includes a circuit configured to receive a selection corresponding to a selected one of the plurality of hearing aid profiles and to provide the selected one to the hearing aid in response to receiving the selection.

17 Claims, 4 Drawing Sheets

(56) References Cited

OTHER PUBLICATIONS

PCT Search Report and Written Opinion, mailed Nov. 22, 2011, for PCT Application No. PCT/US11/01077, filed Jun. 14, 2011, 9 pages.

Office Action for U.S. Appl. No. 13/708,009, mailed on Jan. 21, 2014, Frederick Charles Neumeyer, "Hearing Aid and Hearing Aid Dual Use Dongle", 6 pages.

* cited by examiner

PORTABLE ELECTRONIC DEVICE AND COMPUTER-READABLE MEDIUM FOR REMOTE HEARING AID PROFILE STORAGE

FIELD

This disclosure relates generally to hearing aids, and more particularly to hearing aids with capabilities for remote storage of hearing aid profiles.

BACKGROUND

Hearing deficiencies can range from partial to complete hearing loss. Often, an individual's hearing ability varies across the range of audible sound frequencies, and many individuals have hearing impairment with respect to only select acoustic frequencies. For example, an individual's hearing loss may be greater at higher frequencies than at lower frequencies.

Hearing aids have been developed to alleviate the effects of hearing losses in individuals. In instances where the individual's hearing loss varies across frequencies, such hearing aids can be tuned by an audiologist, for example, to compensate for the unique variations of the individual's hearing loss.

Conventionally, hearing aids range from ear pieces configured to amplify sounds to more sophisticated hearing aid devices that are configurable by a hearing specialist. In an example, a hearing health professional takes measurements using calibrated and specialized equipment to assess an individual's hearing capabilities in a variety of sound environments, and then programs the hearing aid profiles based on the calibrated measurements to enhance the performance of the hearing aid in a specific acoustic environment, such as in a crowd, outdoors, or in a quiet room. High-end hearing aids may include between two and six different hearing aid profiles, often including a normal profile and a phone profile as two of the hearing aid profiles. However, even six profiles cannot cover the large range of parameters and response characteristics needed to properly tune a hearing aid to the various acoustic environments to which a user may be exposed, and such high-end hearing aids do not allow the user to adjust the hearing aid profile itself.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of a hearing aid system are described below that include a computing device (such as a cell phone, personal digital assistant (PDA), or other computing system) configured to communicate with a hearing aid through a wireless communication channel to allow a user to utilize the computing device to configure a desired hearing aid profile of the hearing aid. In addition to volume and tone, the user can configure various parameters of a sound-shaping algorithm (hearing aid profile) and provide the hearing aid profile to the hearing aid for use by a processor of the hearing aid to shape audio signals to produce modulated audio signals, which can be reproduced by a speaker of the hearing aid. The computing device can store a larger number of pre-configured hearing aid profiles in addition to instructions for selecting one of the hearing aid profiles for use, instructions for modifying one of the hearing aid profiles to produce a modified version for use, and instructions for generating new hearing aid profiles. Thus, a user can customize his/her own listening experience by adjusting operation of the hearing aid using the computing device and without having to visit a hearing health professional.

Figure 1:
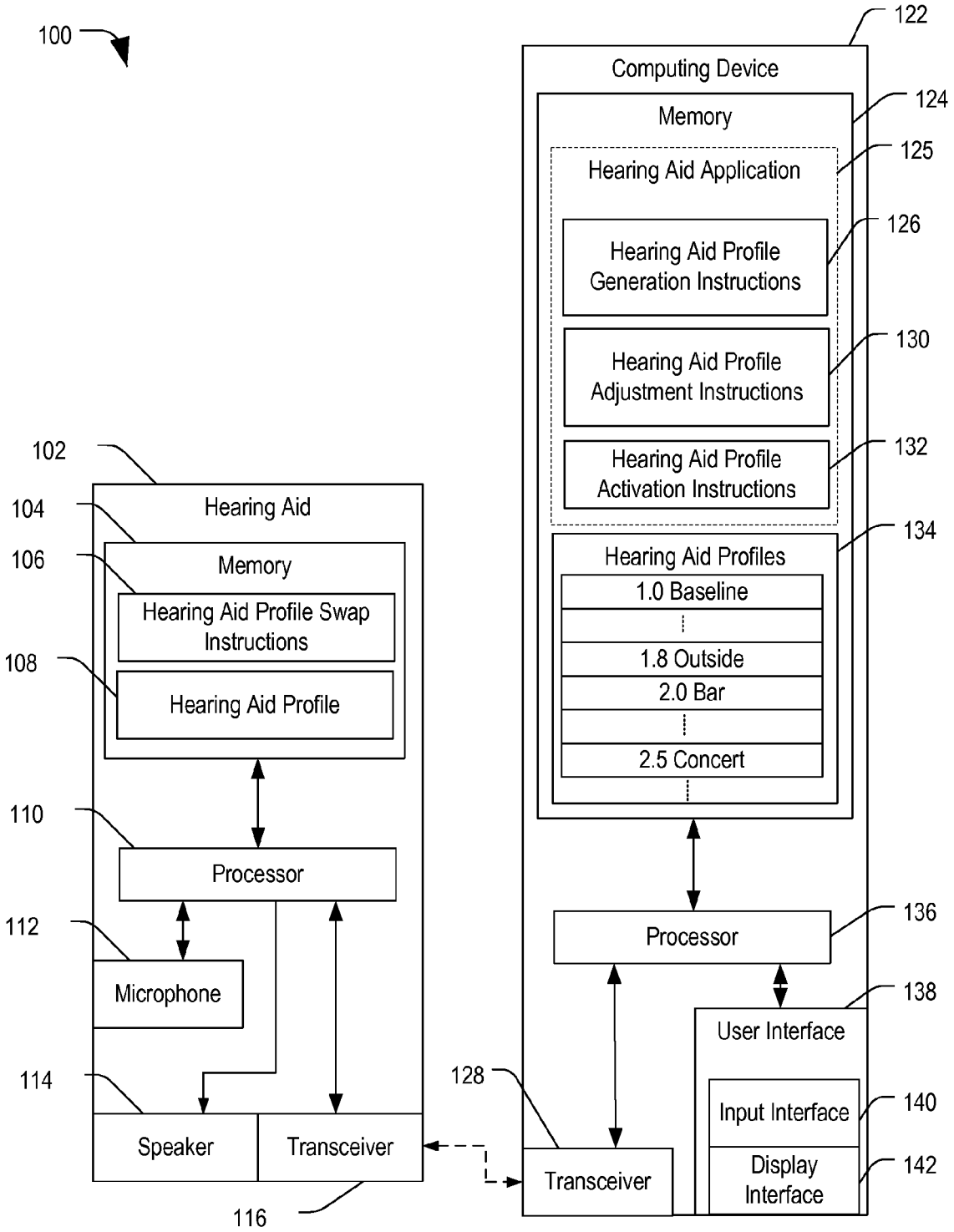
FIG. 1 is a block diagram of an embodiment of a hearing aid system including a hearing aid and a computing device for providing remote storage and adjustment of hearing aid profiles.

FIG. 1 is a block diagram of an embodiment of a hearing aid system 100 including a hearing aid 102 and a computing device 122 for providing remote storage and adjustment of hearing aid profiles. Hearing aid 102 includes a transceiver 116 that is a radio frequency transceiver configured to communicate with computing device 122 through a wireless communication channel. Hearing aid 102 also includes a processor 110 and a memory 104, which is accessible by processor 110. Memory device 104 stores hearing aid swap instructions 106 and at least one hearing aid profile 108.

Hearing aid 102 further includes one or more microphones 112 (microphone 112 may be a single microphone or multiple microphones working in conjunction with each other) to receive environmental noise or sounds and to convert the sounds into electrical signals. One or more microphones 112 provides the electrical signals to signal processor 110, which processes the electrical signals according to a hearing aid profile associated with the user to produce a modulated output signal that is customized to a user's particular hearing ability. Processor 110 is coupled to a speaker 114, which is configured to reproduce the modulated output signal as an audible sound at or within an ear canal of the user.

Computing device 122 is a personal digital assistant (PDA), smart phone or cell phone, tablet computer with a touch screen display, such as Apple's Ipad®, notebook computer or other portable computing device adapted to send and receive radio frequency signals according to any protocol compatible with hearing aid 102. The term "computing device" is used throughout this disclosure to refer to a system that has the capability to send and receive a wide variety of signals to and from a network, such as a public switched telephone network, a wireless network, a computer network, or any combination thereof. In some instances, the computing device may be a simple system designed to send and receive voice information, or a complex system including further computational functionality. A "portable computing device" is one that can be held in a hand or worn comfortably by a user. The portable computing device may be multifunctional and programmed to perform other tasks in addition to communicating with hearing aid 102. Some examples of other tasks include but are not limited to executing a game, performing phone calls, accessing a calendar, or providing an alarm clock. One representative embodiment of computing device 122 includes the Apple iPhone®, which is commercially available from Apple, Inc. of Cupertino, Calif. or the Blackberry®, available from Research In Motion Limited of Waterloo, Ontario. Other types of mobile telephone devices with short range wireless capability can also be used. Such telephone devices can communicate with a network to perform one or more of its ordinary functions, and can be configured to communicate with hearing aid 102 through the wireless communication channel.

Computing device 122 includes a memory 124 coupled to a processor 136. Computing device 122 further includes a transceiver 128 coupled to processor 136 and configured to send and receive data packets through the communication channel to transceiver 116 in hearing aid 102. Computing device 122 also includes a user interface 138, which includes a display interface 142 (such as a liquid crystal display or LCD) to display information to a user and an input interface 140 (e.g., a keypad, a keyboard, a pointer, or some other interface for receiving user input) to receive user input, respectively. In some embodiments, display interface 142 and input interface 140 are combined in a single component, such as in a touch screen on a smart phone.

Memory 124 stores a plurality of hearing aid profiles 134 and a plurality of instructions which are executable by processor 136, including a hearing aid application 125. Hearing aid application 125 includes hearing aid profile generation instructions 126, profile adjustment instructions 130, and profile activation instructions 132. Hearing aid profile generation instructions 126, when executed by processor 136, cause processor 136 to generate new hearing aid profiles, which can be stored in hearing aid profiles 134. Hearing aid profile adjustment instructions 130, when executed by processor 136, cause processor 136 to adjust an existing hearing aid profile, such as one of hearing aid profiles 134 and/or a hearing aid profile executed by processor 110 within hearing aid 102. Hearing aid activation instructions 132, when executed by processor 136, cause processor 136 to provide a hearing aid profile or a hearing aid profile adjustment to hearing aid 102 via transceiver 128.

As mentioned above, both hearing aid 102 and computing device 122 include memory devices to store hearing aid profiles. As used herein, the term "hearing aid profile" refers to a collection of acoustic configuration settings for hearing aid 102, which are used by processor 110 within hearing aid 102 to shape acoustic signals. Each of the hearing aid profiles includes one or more parameters configured according to the user's hearing characteristics and designed to compensate for the user's hearing loss or otherwise shape the sound received by one or more microphones 112 for a particular acoustic environment or situation. In particular, the one or more parameters are configurable to customize the sound shaping and to adjust the response characteristics of hearing aid 102, so that signal processor 110 can apply a customized hearing aid profile to a sound-related signal to compensate for hearing deficiencies of the user, eliminate unwanted sounds or otherwise enhance the sound-related signals. Such parameters can include signal amplitude and gain characteristics, signal processing algorithms, frequency response characteristics, coefficients associated with one or more signal processing algorithms, or any combination thereof. The signal amplitude and gain characteristics may be frequency specific, making it possible to amplify signal content at selected frequencies and to suppress the signal content at other frequencies. In some instances, processor 110 executes instructions stored in memory 104 to shape audio signals to compensate for the user's hearing deficiencies, and the one or more parameters are configurable by replacing or modifying the instructions.

In an example, computing device 122 receives a signal to select a hearing aid profile from the plurality of hearing aid profiles 134. The signal may include a user selection of a profile received from user interface 138 or from hearing aid 102 detecting changes in the acoustic environment. In one example, an identifier associated with the selected hearing aid profile is presented to the user on the display interface 142 together with one or more user-selectable options, such as a first option to edit the hearing aid profile, a second option to activate the profile, and/or a third option to generate a new hearing aid profile. Such user-selectable options can include soft-buttons, pull-down or drop-down menus, and/or other types of buttons or menus.

If the user selects the first option to edit the hearing aid profile, processor 136 executes hearing aid profile adjustment instructions 130 and provides text and/or graphics (including one or more user-selectable options) in a graphical user interface to display interface 142. The user can interact with input interface 140 in response to the graphical user interface to edit the hearing aid profile settings. Once the profile is adjusted, processor 136 stores the alterations in memory 124 (either overwriting the selected hearing aid profile or inserting a new hearing aid profile into hearing aid profiles 134) and executes hearing aid profile activation instructions 132 to communicate the adjusted profile to hearing aid 102 through the communication channel. This adjustment process may operate in a manner similar to an adjustment process executed by a hearing health professional (such as an audiologist), except that the user can configure his/her own hearing aid profiles using a cell phone or other computing device, and without having to visit the health professional.

If the user selects the second option to activate the hearing aid profile, processor 136 executes hearing aid profile activation instructions 132 and communicates the selected hearing aid profile to hearing aid 102. In this instance, the user may activate a recommended hearing aid profile by interacting with the input interface, causing the recommended hearing aid profile to be sent to hearing aid 102, which stores the hearing aid profile and applies it to shape sounds.

If the user selects the third option to generate a new profile, processor 136 executes hearing aid profile generation instructions 126, which allows the user to generate a new profile. In one instance, hearing aid profile generation instructions 126 provide a baseline hearing aid profile for the user and provides a graphical user interface including user-selectable options for configuring the hearing aid profile as desired. Alternatively, hearing aid profile generation instructions 126 provide a different hearing aid profile as a starting point and provides a graphical user interface including user-selectable options for configuring the different hearing aid profile as desired. Hearing aid profile generation instructions 126 may also include an automatic process that causes computing device 122 to detect and analyze the user's current acoustic environment and to generate a base-line profile for the user's current acoustic environment, which includes sound filters and gain adjustments to compensate for the user's hearing deficiency while removing undesirable background noise. Once generated, the user may further edit the generated hearing aid profile or simply select it for activation. In each instance, processor 136 stores the profile in memory 124. Processor 136 also selectively executes hearing aid profile activation instructions 132 in response to the user's authorization to activate the hearing aid profile. In some instances, computing device 122 may be configured to automatically a selected hearing aid profile to hearing aid 102 without user selection.

Hearing aid 102 receives a hearing aid profile from computing device 122 and processor 110 executes hearing aid profile swap instructions 106 to replace hearing aid profile 108 with the profile received from computing device 122. Once the profiles are swapped, processor 110 uses the hearing aid profile 108 to shape electrical signals representative of sound received at one or more microphones 112 to produce a shaped audio signal. Processor 110 provides the shaped audio signal to speaker 114 for reproduction to the user as audible sound.

In an embodiment, memory 104 stores a plurality of hearing aid profiles, such as hearing aid profile 108. In this instance, in response to receiving a hearing aid profile from computing device 122, processor 110 may replace one of the hearing aid profiles in memory 104. In an example, processor 110 may use a first in-first out technique, over-writing the "first in" hearing aid profile with the new hearing aid profile. In another example, processor 110 may replace a "least used" hearing aid profile with the new hearing aid profile. In still another example, processor 110 may use some other storage scheme for updating hearing aid profile 108 in memory 104.

While the embodiment depicted in FIG. 1 illustrates a single hearing aid, it should be appreciated that some users will utilize a pair of hearing aids, in which case both hearing aids include the components illustrated in hearing aid 102 in FIG. 1. Further, a user may interact with user interface 138 to configure each hearing aid individually, making it possible to selectively adjust parameters for and configure one or both of the hearing aids and/or to provide a first hearing aid profile to one hearing aid and a second hearing aid profile to another hearing aid. In the case of adjusting two hearing aids, some parameters may be adjusted in the same manner, while other parameters are adjusted only in one.

In a particular example, a user may interact with computing device 122 to control a hearing aid profile applied by processor 110 of hearing aid 102. In particular, the user can generate, modify, and/or select a hearing aid profile and trigger its transmission to hearing aid 102 through the wireless communication channel, making it possible for the user to configure his/her own hearing aid without having to make a trip to visit a hearing health professional.

In the above discussion, hearing aid 102 is depicted in block diagram form. However, hearing aid 102 may be implemented in any number of configurations ranging from hearing aid implants to behind-the-ear types of hearing aids. One example of a behind-the-ear hearing aid that is configurable to communicate with computing device 122 to receive a hearing aid profile that can be applied by hearing aid 102 to shape sound is described below with respect to FIG. 2.

Figure 2:
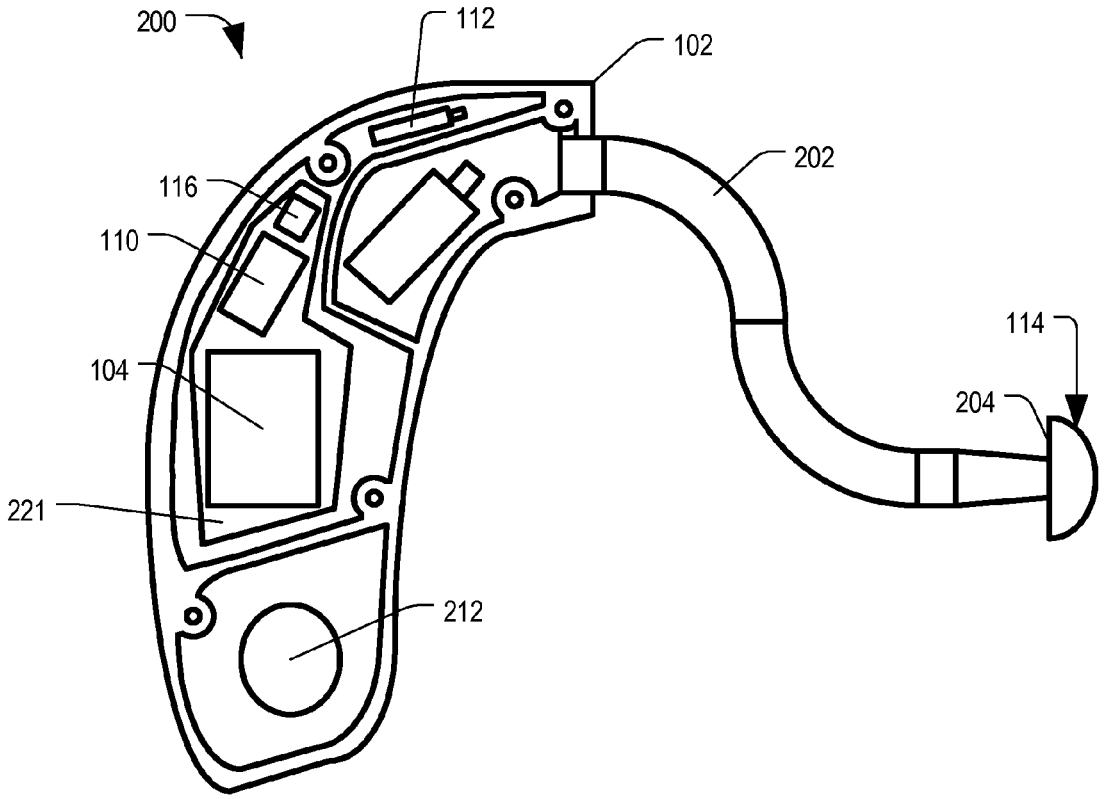
FIG. 2 is a cross-sectional view of a representative embodiment of an external hearing aid including a transceiver to access the remote storage unit.

FIG. 2 is a cross-sectional view of a representative embodiment 200 of an external hearing aid 102 including transceiver 116 to access the remote storage unit. Hearing aid 102 includes one or more microphones 112 to convert sounds into electrical signals. One or more microphones 112 is communicatively coupled to circuit board 221, which includes processor 110, transceiver 116, and memory 104. Further, hearing aid 102 includes an ear canal tube 202 that extends from the housing of hearing aid 102 to an ear bud 204 that fits within an ear canal of a user. In an example, speaker 114 is located within ear bud 204 and is coupled to processor 110. Speaker 114 reproduces audio data within the ear canal of a user as audible sound. Further, hearing aid 102 includes a battery 212 to supply power to the other components. In an alternative example, speaker 114 may be located within the housing of hearing aid 102 and configured to reproduce audio data to ear bud 204 through ear tube 202.

During operation, one or more microphones 112 converts sounds into electrical signals and provides the electrical signals to processor 110, which processes the electrical signals according to a hearing aid profile associated with the user to produce a modulated output signal that is customized to a user's particular hearing ability. The modulated output signal is provided to speaker 114, which operates as a speaker to reproduce the modulated output signal as an audio signal and which provides the audio signal to the ear piece through the canal tube.

While hearing aid 102 illustrates an external "wrap-around" hearing device, other types of hearing aids may also be configured to communicate with computing device 122 to receive hearing aid profiles. In particular, the remote storage of hearing aid profiles can be used with other types of hearing aids, including hearing aids designed to be worn behind the ear or within the ear canal, or hearing aids designed for implantation. The embodiment of hearing aid 102 depicted in FIG. 2 represents only one of many possible implementations with which the user-configurable signal processor may be used.

Figure 3:
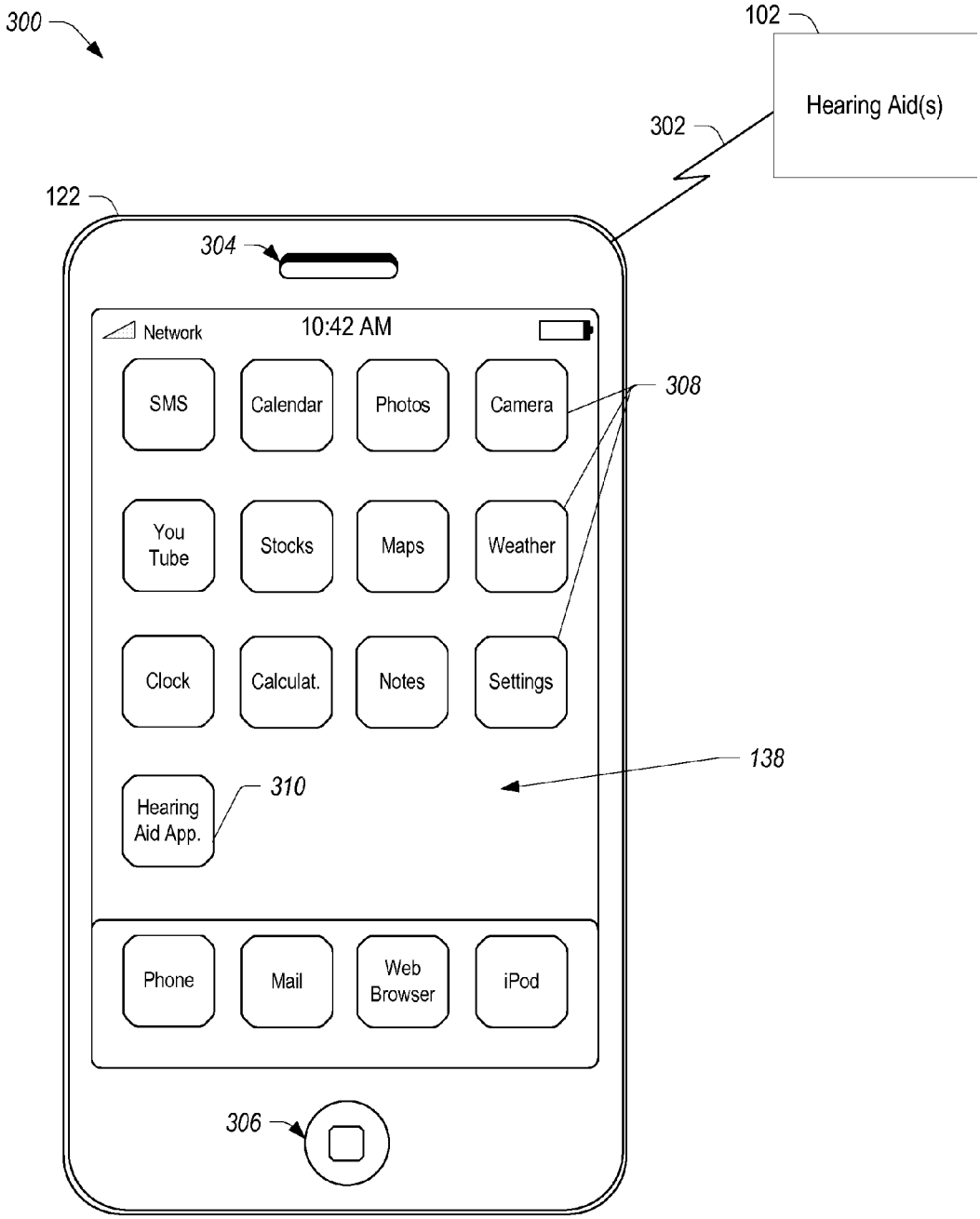
FIG. 3 is a partial top view and partial block diagram of an embodiment of the hearing aid system of FIG. 1.

FIG. 3 is a partial top view and partial block diagram 300 of an embodiment of the hearing aid system 100 of FIG. 1. Diagram 300 includes computing system 122, represented by a mobile telephone having a touch-screen interface 138 for receiving user input and for displaying information and user-selectable options, such as buttons 308. Computing system 122 includes a speaker (generally indicated at 304), display interface 142 and input interface 140 implemented as a touch-screen interface 138, and one or more microphones (generally indicated at 306). Further, computing system 122 includes a processor and instructions executable by the processor to communicate with hearing aid 102 via a wireless communication channel. In the illustrated example, a graphical user interface displayed on touch-screen interface 138 includes a hearing aid application button 310, which accessible by a user to trigger execution of hearing aid application 125 (depicted in FIG. 1) to select a hearing aid profile for communication to hearing aid 102 through wireless communication channel 302. In an embodiment, wireless communication channel 302 is a short-range wireless channel, such as a Bluetooth® communication channel.

In an example, the user may utilize his/her cell phone or computer to configure, adjust, or otherwise alter the sound-shaping functionality of hearing aid 102. In a particular example, the hearing aid application 125 (represented by hearing aid application button (or icon) 310) may be downloaded from a network and stored in a memory of computing device 122. Once installed, hearing aid application 125 can be triggered by a user through interaction with hearing aid application button 310, causing computing device 122 to select, modify, or create a hearing aid profile and to communicate wirelessly with hearing aid 102 to provide the hearing aid profile to reconfigure operation of hearing aid 102.

While the above-examples describe communication between computing device 122 and a single hearing aid 102, it should be appreciated that many hearing impaired individuals have hearing impairments in both ears and wear a pair of hearing aids, one in their right ear and one in their left ear. Computing system 122 is configured to select, edit or create a hearing aid profile for each hearing aid and provide the selected hearing aid profiles to their respective hearing aids. An example of a system including a pair of hearing aids is described below with respect to FIG. 4.

Figure 4:
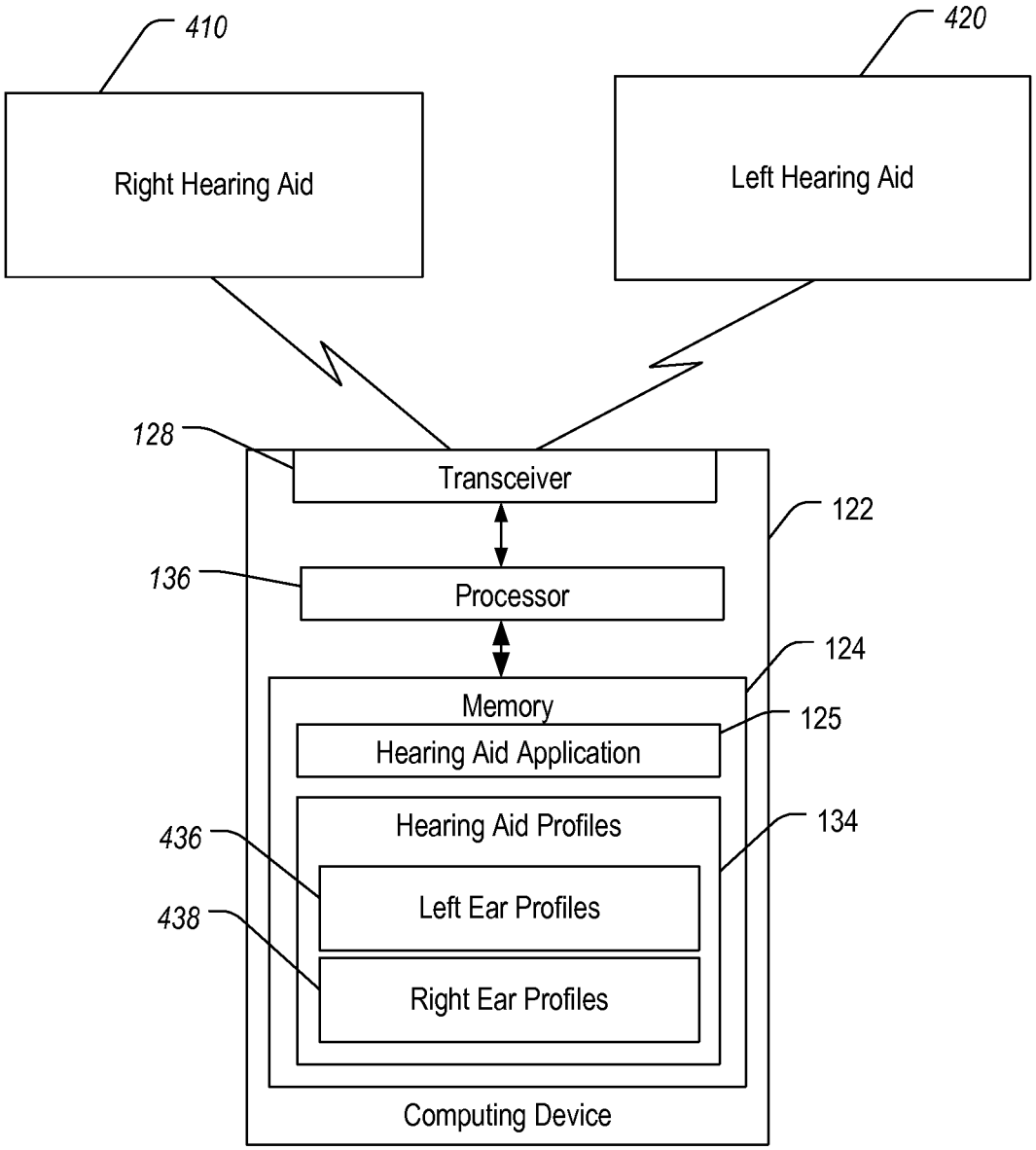
FIG. 4 is a block diagram of an embodiment of the hearing aid system of FIG. 1 including a pair of hearing aids and a computing device for providing remote storage and independent adjustment of hearing aid profiles for each hearing aid.

FIG. 4 is a block diagram of a hearing aid system 400, which is an embodiment of the hearing aid system 100 of FIG. 1, including a pair of hearing aids (right hearing aid 410 and left hearing aid 412) and computing device 122 for providing remote storage and adjustment of hearing aid profiles 134, including right ear profiles 436 for use by right hearing aid 410 and left ear profiles 438 for use by left hearing aid 420. Both right hearing aid 410 and left hearing aid 420 include the functionality of hearing aid 102 (depicted in FIG. 1). Right hearing aid 410 applies a selected right ear profile from right ear profiles 436 to shape sounds reproduced for the right ear of the user, and left hearing aid 420 applies a selected left ear profile from left ear profiles 438 to shape sounds reproduced for the left ear. In some instances, the hearing aid profiles 134 compensate for the user's hearing impairments by shaping the sounds differently for the right ear and the left ear. Processor 136 executes hearing aid application 125 to select, modify, or create a hearing aid profile for the right hearing aid 410 and/or the left hearing aid 420. In a particular example, hearing aid application 125 allows the right hearing aid 410 and the left hearing aid 420 to be configured independently. Moreover, hearing aid application 125 allows for independent selection, adjustment, and/or delivery of the hearing aid profile to a particular hearing aid, making it possible for the user to adjust one hearing aid without adjusting the other. In particular, the user may adjust or replace a right ear profile without altering the left ear profile.

In an embodiment, hearing aid application 125 may be configured to automatically make corresponding adjustments to a hearing aid profile for the other hearing aid. In this example, hearing aid application 125 receives user inputs to configure a selected left ear profile, and adjusts the selected left ear profile and a corresponding right ear profile based on the user input before providing both the left and right ear profiles to left hearing aid 410 and right hearing aid 420, respectively. By providing for independent and/or coordinated adjustment of left hearing aid 410 and right hearing aid 420, hearing aid system 400 provides a fully customizable hearing experience.

Computing device 122 includes memory 124 coupled to processor 136, which is coupled to transceiver 128. Memory 124 includes hearing aid application 125 and hearing aid profiles 134, which are executable by processor 136 to cause processor 136 to operate as described with respect to FIG. 1. Hearing aid profiles 134 are divided into two sets: left ear profiles 436 and right ear profiles 438. Left ear profile 436 and right ear profile 438 are configured to shape acoustic signals individually for either the left hearing aid 410 or the right hearing aid 420 to provide a customized sound experience, which may include different sound-shaping for left hearing aid 410 as compared to right hearing aid 420.

Left ear profiles 436 and right ear profiles 438 may be grouped into left/right pairs to provide a relatively cohesive acoustic shaping scheme. It should be understood that when hearing aid profiles 134 are configured in left/right pairs, hearing aid application 125 allows the user to adjust overriding hearing parameters via user interface 138, and processor 136 may apply the adjustments to each profile differently to correctly generate the hearing aid profile scheme desired by the user as dictated by the user's hearing loss for each ear. In an example, an amplitude adjustment for a left ear profile may result in a proportional adjustment to the corresponding right ear profile. In another example, a particular adjustment for a right ear profile may be selectively applied, partially applied, proportionally applied, or ignored with respect to the corresponding left ear profile.

In one example, computing device 122 receives a signal to select a right ear profile from the plurality of right ear profiles 438. In response to the signal, processor 136 executes hearing aid application 125 to allow the user to edit the right ear profile, or to provide the right ear profile from right ear profiles 438 to right hearing aid 410, which uses the right ear profile to shape sound as described in FIG. 1. If hearing aid application 125 is configured to group left ear profiles 436 and right ear profiles 438 into left/right pairs, hearing aid application 125 may selectively adjust the corresponding left ear profile from the plurality of left ear profiles 436 and provide the corresponding left ear profile (including any such adjustments) to left hearing aid 420, which uses the left ear profile to shape sounds as described in FIG. 1. In another example, the user interacts with user interface 138 to select, edit, or generate a new hearing aid profile for one or both of the hearing aids 410 and 420. It should be understood that the user may only elect to select, edit, or generate a hearing aid profile for the right hearing aid, the left hearing aid or both. Alternatively, the user may interact with hearing aid application via user interface 138 to generate a hearing aid profile scheme, which allows the user to select, edit, or generate a pair of hearing aid profiles to be used in conjunction with each other to achieve the desired sound shaping results.

In conjunction with the systems 100, 200, 300, and 400 in FIGS. 1-4, a hearing aid system is described that includes a computing device configured to communicate with one or more hearing aids through a wireless communication channel. The computing device stores hearing aid profiles for the one or more hearing aids and includes a hearing aid application that is executable by a processor within computing device to allow a user to adjust selected hearing aid profiles during the operation of the hearing aids. The hearing aid application may cause transceiver to communicate information to one or more hearing aids to provide feedback to the user to verify the adjustments.

Although the present invention has been described with reference to preferred embodiments, workers skilled in the art will recognize that changes may be made in form and detail without departing from the scope of the invention.

What is claimed is:

1. A portable electronic device comprising:

a transceiver configurable to communicate with a first hearing aid and a second hearing aid through a radio frequency (RF) communication channel while the first and second hearing aids are in operation;

a memory configured to store a plurality of hearing aid profiles executable by a digital signal processor of the hearing aid to shape audio signals to compensate for a user's hearing deficiency;

an input/output interface for receiving inputs and displaying information; and a circuit configured to:

receive a user input indicating a selection of a first hearing aid profile and a second hearing aid profile from the plurality of hearing aid profiles;

display settings related to the first and second hearing aid profiles on the input/output interface;

receive a second user input to switch between adjusting the first and second hearing aid profiles jointly or individually;

receive a third user input to adjust at least one of the right and left hearing aid profiles; and transmit the right and the left hearing aid profiles to the first and second hearing aids via the transceiver.

2. The portable electronic device of claim 1, wherein the portable electronic device comprises at least one of a portable media player and a cell phone.

3. The portable electronic device of claim 1, wherein the first selected hearing aid profile and the second selected hearing aid profile are independently adjustable.

4. The portable electronic device of claim 1, wherein the first selected hearing aid profile and the second selected hearing aid profile are adjustable in combination by the circuit to provide a hearing aid profile scheme.

5. The portable electronic device of claim 1, wherein the second selected hearing aid profile is adjusted automatically by the circuit based on a user adjustment to the first selected hearing aid profile.

6. The portable electronic device of claim 1, further comprising an input interface coupled to the circuit and configured to receive user inputs.

7. The portable electronic device of claim 1, wherein the circuit comprises a processor configured to execute instructions to perform a variety of functions.

8. The portable electronic device of claim 7, wherein the instructions include at least one of a phone function, a calendar function, a music playback function, a calculator function, and a web browser function.

9. A device comprising:

a transceiver configurable to communicate with both a left and right hearing aid through a wireless communication channel while the left and right hearing aids are in operation;

an input interface for receiving user input from a user;

an output interface for providing information to the user;

a processor coupled to the transceiver and to the input interface; and a memory configured to store a plurality of hearing aid profiles executable by a digital signal processor of the hearing aid to shape audio signals to compensate for a user's hearing deficiency, the memory accessible to the processor and configured to store instructions that, when executed by the processor, cause the processor to:

receive a user input indicating a selection of a left hearing aid profile and a right hearing aid profile from the plurality of hearing aid profiles;

display settings related to the left and right hearing aid profiles;

receive a second user input to switch between adjusting the right and left hearing aid profiles jointly or individually;

receive a third user input to adjust at least one of the right and left hearing aid profiles; and transmit the right and the left hearing aid profiles to the right and left hearing aids via the transceiver.

10. The device of claim 9, wherein the input interface comprises a touch screen display.

11. The device of claim 9, wherein the memory further comprises hearing aid profile generation instructions that, when executed by processor, cause the processor to:

receive a fourth user input to initiate generation of a new hearing aid profile;

generate the new hearing aid profile in response to the fourth user input based in part on a hearing loss of the user and a particular acoustic environment; and transmit the new hearing aid profile to the hearing aid.

12. The device of claim 9, further comprising:

a housing defining an enclosure including the transceiver, the input interface, the processor, and the memory;

wherein the housing is sized to fit a user's hand.

13. A device comprising:

a display interface for displaying information to a user;

an input interface for receiving user input;

a transceiver configurable to communicate with a right and a left hearing aid through a radio frequency (RF) communication channel while the left and right hearing aids are in operation;

a memory configured to store a plurality of hearing aid profiles executable by a digital signal processor of the hearing aid to shape audio signals to compensate for a user's hearing deficiency, the memory further configured to store a plurality of instructions including graphical user interface instructions and hearing aid configuration instructions;

a processor coupled to the memory and to the transceiver, the processor configured to execute the graphical user interface instructions to:

produce a graphical user interface on the display interface;

receive a first user input corresponding to a user-selectable element of the graphical user interface to select a hearing aid schema for adjusting a first hearing aid profile and a second hearing aid profile, the first hearing aid profile corresponding to the settings on the right hearing aid and the second hearing aid profile corresponding to the settings on the left hearing aid;

receive a second user input corresponding to a user-selectable element of the graphical user interface to adjust at least one setting of the schema, wherein adjusting the at least one element of the schema adjust at least one setting of the first hearing aid profile and at least one setting of the second hearing aid profile;

receive a third user input corresponding to a user-selectable element of the graphical user interface to toggle between adjusting the at least one element of the schema and adjusting at least one setting of the first hearing aid profile without adjusting at least one setting of the second hearing aid profile; and receive a fourth user input corresponding to a user-selectable element of the graphical user interface to cause the device to provide the first hearing aid profile to the right hearing aid and the second hearing aid profile to the left hearing aid.

14. The device of claim 13, wherein the plurality of instructions includes hearing aid profile adjustment instructions that, when executed by the processor, cause the processor to:

receive a fifth user input corresponding to a user-selectable element of the graphical user interface to create a new hearing aid profile;

provide a graphical user interface including one or more user-selectable options for generating and programming the hearing aid profile, the graphical user interface including data related to a current acoustic environment of the user; and communicate the hearing aid profile through the communication channel to the hearing aid as the selected hearing aid profile.

15. The device of claim 13, wherein the plurality of instructions includes phone instructions that, when executed by the processor, cause the processor to provide telephone functionality by communicating audio data to a communications network.

16. A computer readable device comprising instructions that, when executed by one or more processors, cause the one or more processors to:

display a graphical user interface including multiple user-selectable options, a right hearing aid profile and a left hearing aid profile on a display, at least one of the multiple user-selectable options to toggle between a first mode and second mode, the first mode to adjust the right hearing aid profile and the left hearing aid profile in unison and the second mode to adjust the right hearing aid profile and the left hearing aid profile individually, and at least one other of the multiple user-selectable options to adjust at least one setting of either the right hearing aid profile, the left hearing aid profile or both the right and left hearing aid profiles;

receive a user input corresponding to one of the multiple user-selectable options; and communicate the right hearing aid profile to a right hearing aid and the left hearing aid profile to a left hearing aid through a wireless communication channel based on the user input.

17. The computer-readable device of claim 16, further comprising second instructions that, when executed by the one or more processors, cause the one or more processors to:

provide a user-selectable option for creating a new hearing aid profile;

provide user options for generating the new hearing aid profile in response to a user input selecting the option for creating a new hearing aid profile;

store the new hearing aid profile in the computer-readable device; and provide the new hearing aid profile to the right and left hearing aids through the wireless communication channel.

* * * * *